US005713256A

United States Patent [19]

Keeny

[11] Patent Number: 5,713,256

[45] Date of Patent: Feb. 3, 1998

[54] DUAL SPEED LIMITS FOR A CUT-OFF

[75] Inventor: Thomas R. Keeny, Lindenwold, N.J.

[73] Assignee: The Langston Corporation, Cherry Hill, N.J.

[21] Appl. No.: 208,758

[22] Filed: Mar. 9, 1994

[51] Int. Cl.[6] ..... B26D 5/20

[52] U.S. Cl. ..... 83/26; 83/38; 83/76; 83/110; 83/324; 83/342

[58] Field of Search ..... 83/311, 342, 343, 83/345, 363, 110, 26, 38, 76, 324, 354

[56] References Cited

U.S. PATENT DOCUMENTS

| | | | |
|---|---|---|---|
| 1,680,048 | 8/1928 | Iversen . | |
| 2,037,469 | 4/1936 | Harless | 164/66 |
| 2,149,822 | 3/1939 | Ungar | 164/68 |
| 2,202,872 | 6/1940 | Shields | 164/68 |
| 2,215,762 | 9/1940 | Morrison | 164/68 |
| 2,228,896 | 1/1941 | MacFarren | 164/68 |
| 2,244,673 | 6/1941 | Bruker | 164/66 |
| 2,318,173 | 5/1943 | Luehrs | 164/66 |
| 2,410,555 | 11/1946 | Stevens | 164/68 |
| 2;659,437 | 11/1953 | Huck | 164/67 |
| 2,670,796 | 3/1954 | Orr | 164/68 |
| 2,751,983 | 6/1956 | Shields | 164/68 |
| 2,850,092 | 9/1958 | Teplitz | 83/311 |
| 2,971,414 | 2/1961 | Owen | 83/75 |
| 3,003,380 | 10/1961 | Moser et al. | 83/299 |
| 3,138,074 | 6/1964 | Hartbauer | 93/8 |
| 3,176,557 | 4/1965 | Drenning et al. | 83/76 |
| 3,247,746 | 4/1966 | Nystrand | 83/342 |
| 3,387,518 | 6/1968 | Bernhardt et al. | 83/37 |
| 3,606,811 | 9/1971 | Hallden | 83/305 |
| 3,608,411 | 9/1971 | Schmidt | 83/38 |
| 3,626,457 | 12/1971 | Duerr et al. | 83/74 |
| 3,668,957 | 6/1972 | Nido | 83/37 |
| 3,745,864 | 7/1973 | Watson | 83/315 |
| 3,807,262 | 4/1974 | Vits | 83/117 |
| 3,882,745 | 5/1975 | Garrett et al. | 83/311 |
| 3,899,945 | 8/1975 | Garrett et al. | 83/38 |
| 4,183,271 | 1/1980 | Martin | 83/156 |
| 4,196,645 | 4/1980 | Shimizu et al. | 83/37 |
| 4,201,102 | 5/1980 | Rudszinat | 83/324 |
| 4,283,975 | 8/1981 | Knoll | 83/76 |
| 4,289,052 | 9/1981 | Woolston et al. | 83/26 |
| 4,380,943 | 4/1983 | Evans | 83/38 |
| 4,387,614 | 6/1983 | Evans | 83/38 |
| 4,414,873 | 11/1983 | Besemann et al. | 83/311 |
| 4,464,959 | 8/1984 | Larson | 83/37 |
| 4,497,229 | 2/1985 | Carrington et al. | 83/76 |
| 4,724,732 | 2/1988 | Miyauchi et al. | 83/37 |
| 4,756,219 | 7/1988 | Pohl et al. | 83/344 |
| 4,809,573 | 3/1989 | Welch | 83/37 |
| 5,014,582 | 5/1991 | Teik | 83/24 |
| 5,122,964 | 6/1992 | Hayashi et al. | 364/472 |

*Primary Examiner*—Kenneth E. Peterson
*Attorney, Agent, or Firm*—Seidel, Gonda, Lavorgna & Monaco, PC

[57] ABSTRACT

A direct drive cut-off has a pair of cylinders, each having a helical knife blade. The path of the knife blade around the cylinder defines a synchronous length. A corrugated board is passed in a board path direction between the cylinders at a production rate. The knife blades move in proximity to each other in the board direction to cut the continuous board into sheets. The knife blades enter the board path and engage the continuous board at a beginning of engagement position of a knife blade entering edge and depart the board path at an end of engagement position of a knife blade exiting edge. The sheets are accelerated downstream of the cylinders. The cylinders are controlled by a control unit for accelerating and decelerating the rotational speed of the cylinders so that the knife blades engage the continuous board at the specific length cutting the board into sheets. The control unit is responsive to the production rate, and the sheet length. Therefore, for sheets that are shorter than the synchronous length, when the production rate is above a set speed, the control unit accelerates the cylinders after the knife blades complete the cut but before blade engagement is complete so that the knife blades do not engage the accelerating sheet. For production rates below the set speed and sheets shorter than the synchronous length, the control unit accelerates the cylinders when the knife blades reach the end of engagement position of the knife blade exiting edge.

4 Claims, 6 Drawing Sheets

DUAL SPEED LIMITS FOR A CUT-OFF

FIELD OF THE INVENTION

This invention relates to a direct drive cut-off for cutting a continuous corrugated board into sheets of a set length. More particularly the invention relates to increasing the maximum production rate of the cut-off when cutting sheets of a length that are shorter than the synchronous length of the cut-off by beginning acceleration of the knife blades after the cut is complete, but before the knife blades leave the path of the board, and without damaging the trailing edge of the sheet. Thus, a larger portion of the rotational distance is available for acceleration and deceleration of the knife blades.

BACKGROUND OF THE INVENTION

A cut-off is a double rotary knife cutter in which a corrugated board or web passes between two cylinders, each having a knife blade. The cylinders rotate in opposite directions such that the knife blades move in the same direction as they engage the corrugated board. The cylinders are synchronized such that a shearing effect is created when the knife blades cooperate or engage with each other and then move away from each other, thereby cutting the board. The knife blades are mounted helically on the cylinders such that the knife blades interengage the path of the corrugated board during an engagement angle of the rotation of the cylinders.

Since the knife blades are helical, the knife blades initially interact with the corrugated board at a beginning engagement position, i.e., at a knife blade entering edge of the corrugated board. The knife blades cut through the board, completing the cut at a knife blade exit edge, opposite the entering edge, of the corrugated board. The angle through which the knife blades rotate during the cutting of the board (i.e., from the entering edge to the exit edge) is known as the cut (or helix, or shear) angle. The knife blades, however, do not leave the path of the board until the knife blades reach an end engagement position. The angle during which the blades move out of engagement with the board path after the cut is complete is known as the clearance angle. The blade engagement angle is the sum of the cut (or helix, or shear) angle and the clearance angle (See FIG. 8), as described in detail below.

During the cut angle, when the knife blades are engaging the board, the blades must move at a tangential speed equal to the production rate of the board to prevent damaging the board. The production rate of the board is the rate the corrugated board moves through the cut-off. The knife blade cylinders are slightly skewed from perpendicular to the board path. Therefore, as the knife blades rotate and engage the moving board, the knife blades cut a straight path. FIG. 7 shows the knife blade path. The knife blade path, if the board were not moving, is shown in phantom in FIG. 7. As the knife blade moves with the corrugated board, the knife blades cut through the corrugated board in a scissor or mezzaluna (a curved blade) action.

If the cylinders rotated only at a constant angular velocity, such that the knife blades match the production rate of the board, the helical knife blades would only be capable of cutting the corrugated board into sheets of one specific length, referred to as a synchronous length. To cut sheets of other lengths, the cylinders and associated knife blades must be accelerated or decelerated between cuts. To cut the board into sheets shorter than the synchronous length, the cylinders need to be accelerated between the cutting of the corrugated board to get the knife blades to the position to cut the next sheet from the board. Likewise, to cut the board into sheets longer than the synchronous length, the cylinders need to be decelerated between cuts. The larger the portion of the rotation when the blades overlap and engage the board path (the blade engagement angle), the smaller the portion of rotation which is available for acceleration or deceleration of the cylinders to allow for different sheet lengths. It is recognized that the acceleration and deceleration of the cylinders is limited by mechanical limitations, such as inertia; therefore, for sheets of a length that deviate greatly from synchronous length, the production rate must be slowed.

It has been recognized that to cut the corrugated board into sheets shorter than the synchronous length, there were two alternatives available. These alternatives are associated with the method of rotating the cylinders in order to get the knife blades in position to make the next cut of the corrugated board. As indicated above, the knife blade cylinders are required to accelerate in order to position the knife blades to make the next cut of the corrugated board. The first alternative was to wait until the knife blades had cleared the path of the board (at the end engagement position), before accelerating the cylinders with the knife blades. The second alternative was to begin the acceleration of the cylinders prior to the knife blades clearing the board path but after the knife blades completed the cut (i.e., in the clearance angle portion as seen in FIG. 8).

In both alternatives, the chosen method was used consistently regardless of the production speed of the board. The first alternative was limited by constraints on the machine. A machine can accelerate and decelerate the cylinders and knife blades only so fast, as indicated above. Therefore, as the desired sheet length decreases from that of the synchronous length, the maximum production speed had to be decreased so that the knife blades could, within the limits of the machine, be positioned to cut the next cut.

The second alternative was limited by the speed of the leading sheet. The sheet previously cut from the corrugated board and in front of the knife blade, must be accelerated to avoid being hit by the knife blade. While the lead sheet is accelerated slightly to provide a gap for an operation down stream, an increased acceleration to a speed too much in excess of the production rate will have undesirous effects of skewing and possible scuffing of the sheet. Therefore at low production speeds, the knife blades would hit the lead sheet.

It is desired to maximize production of boards shorter than the synchronous length.

SUMMARY OF THE INVENTION

The present invention is directed to a direct drive cut-off, having a pair of cylinders each having a helical knife blade, and a method for increasing the production rate of cutting sheets from a corrugated board of a preselected length less than a synchronous length. The length of the path of the knife blade around the cylinder defines the synchronous length. The corrugated board is passed in a board path direction between the cylinders at a production rate. The knife blades move in proximity to each other in the board direction to cut the continuous board into sheets. The knife blades enter the board path and engage the continuous board at a beginning engagement position where a knife blade enters the edge and departs the board path at an end engagement position where a knife blade exits the opposite edge. The sheets are accelerated downstream of the cylinders. The knife blade cylinders are controlled by a control unit which accelerates and decelerates the cylinders so that the knife blades cut the continuous board into sheets having a preselected length.

The control unit is responsive to both the production rate and the sheet length. Therefore, for sheets that are shorter than the synchronous length, and when the production rate is above a set speed, the control unit accelerates the knife blade cylinders after the knife blades complete the cut but before the knife blades reach the blade engagement position so that the knife blades do not damage the accelerating sheet. For production rates below the set speed and sheets shorter than the synchronous length, the control unit accelerates the knife blade cylinders when the knife blades reach the end engagement position.

Further objects, features and advantages of the present invention will become more apparent to those skilled in the art as the nature of the invention is better understood from the accompanying drawings and detailed description.

DESCRIPTION OF THE DRAWINGS

For the purpose of illustrating the invention, there are shown in the drawings forms which are presently preferred; it being understood, however, that this invention is not limited to the precise arrangement and instrumentalities shown.

DESCRIPTION OF THE INVENTION

Figure 1:
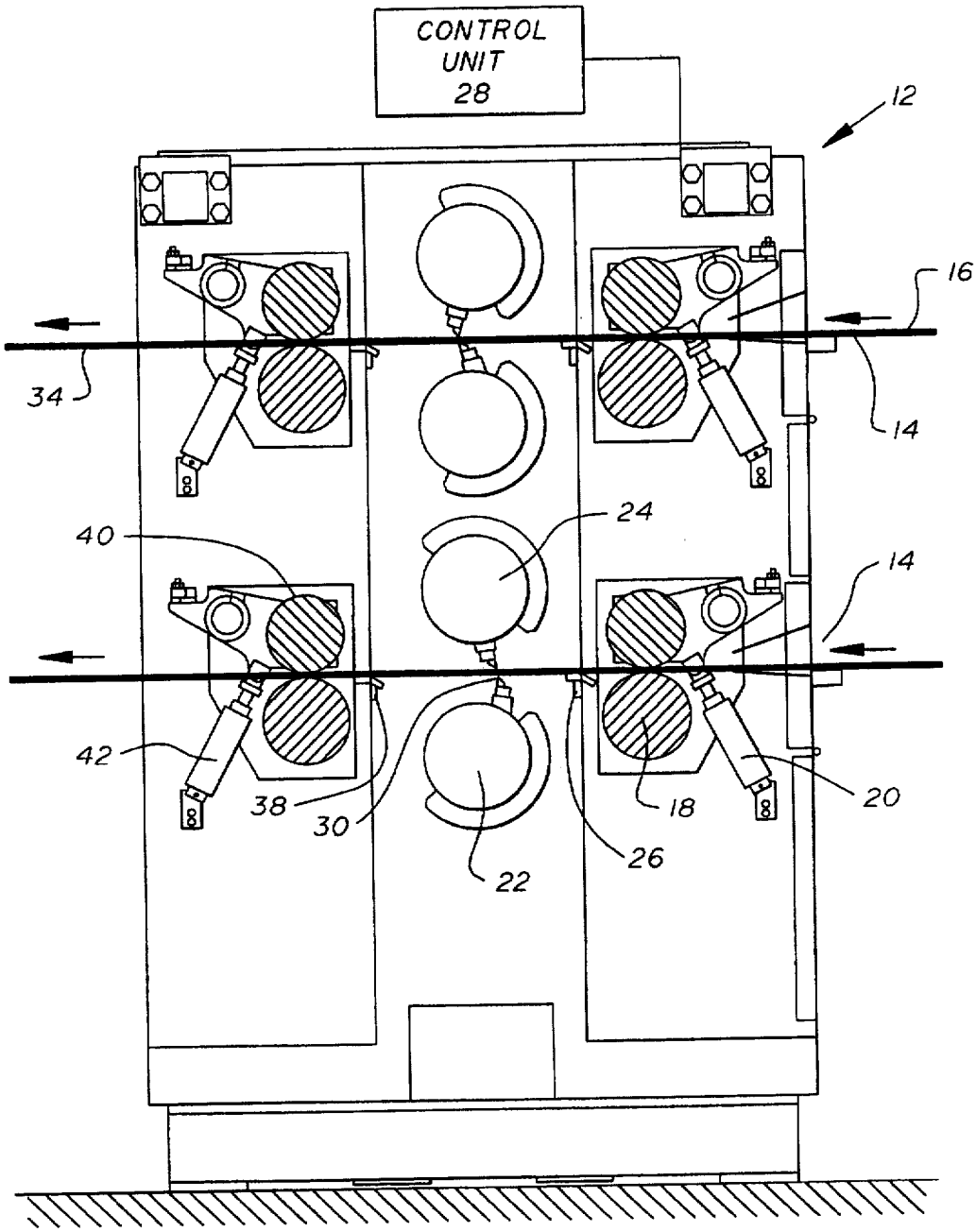
FIG. 1 is a sectional view of the direct drive cut-off of the present invention.

Referring to the drawings in detail, wherein like numerals indicate like elements and where primes (') indicate counterparts of such like elements, there is illustrated in FIG. 1 a direct drive cut-off 12 according to the present invention. The direct drive cut-off 12 cuts a continuous web of corrugated board 16 into sheets 34 of a desired length. The direct drive cut-off 12 has a control unit 28 which controls the operation and receives the desired parameters, such as the desired length of sheets 34, as described below.

The direct drive cut-off 12 shown has a pair of board paths 14. The board paths 14 are two alternative paths which the corrugated board 16 can be sent through the direct drive cut-off 12 to obtain the sheets 34. The board paths 14 are substantially equivalent therein; thus, only one board path will be described in detail.

Each of the board paths 14 of the direct drive cut-off 12 has a pair of feed rollers 18, a pair of cylinders 22 and 24, and a pair of take-up rollers 40 for moving the corrugated board 16 through the direct drive cut-off 12. The corrugated board 16 is fed between the feed rollers 18. The feed rollers 18 rotate in opposite directions moving the corrugated board 16 at a production rate "P." One of the feed rollers 18 is pivotably mounted and is positioned by one or more pneumatic or hydraulic cylinder 20. The direct drive cut-off 12, in a preferred embodiment, has a guide 26 interposed between the feed rollers 18 and the cylinders 22 and 24 for guiding the corrugated board 16.

Figure 8:
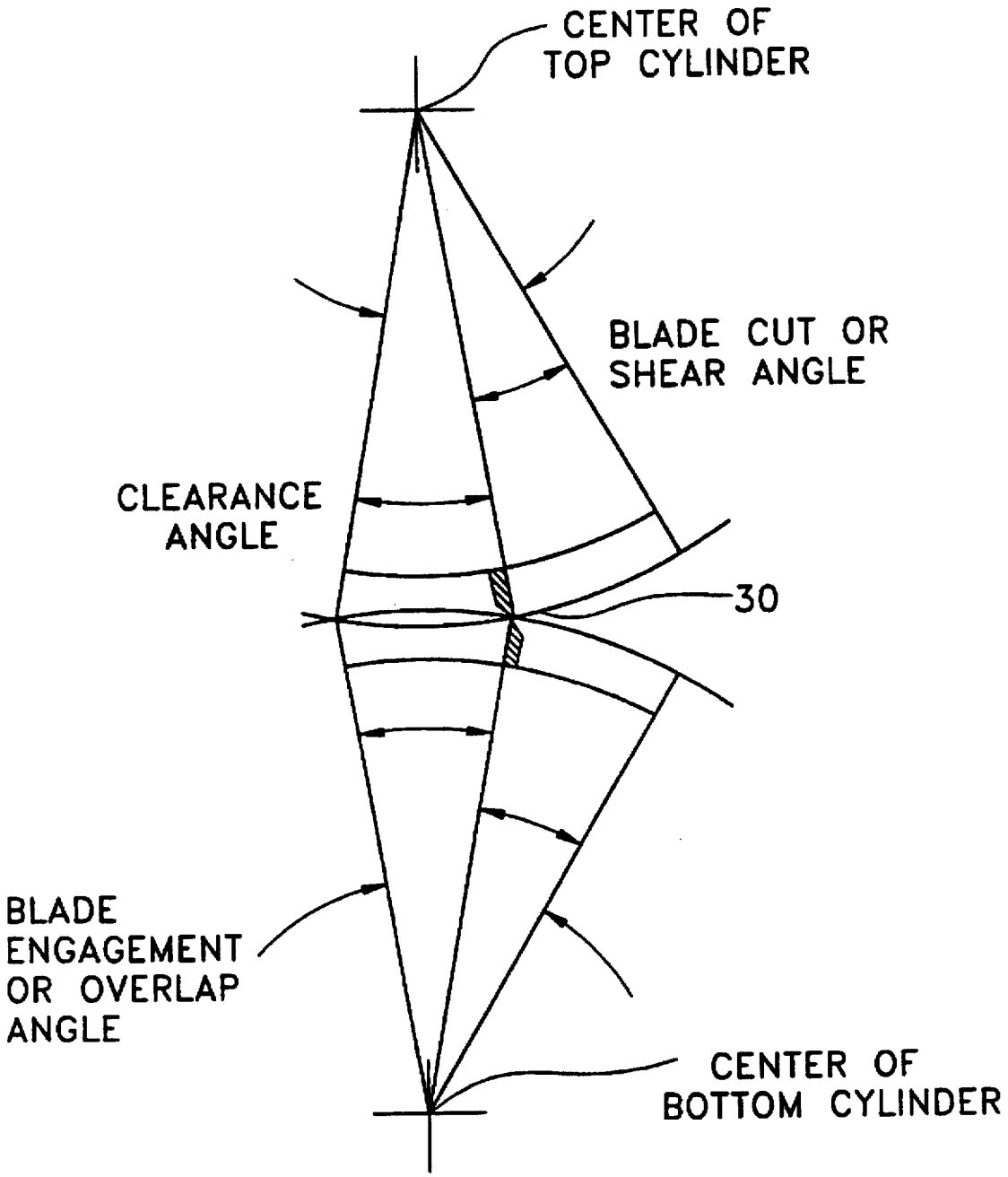
FIG. 8 is a schematic view of the movement of the cylinders showing the cut, clearance and engagement angles.

The continuous web of corrugated board 16 is pushed towards the pair of cylinders 22 and 24 over the guide 26 at the production rate "P." The cylinders 22 and 24 are parallel to each other and are slightly skewed from being perpendicular from the board path 14. The pair of cylinders 22 and 24 rotate in opposite directions so that the cylinders 22 and 24 are both moving in the board path direction where the continuous web of corrugated board 16 passes between them. Each of the cylinders 22 and 24 has a knife blade 30. The knife blade 30 has a helical shape such that the whole knife blade does not engage the corrugated board 16 at the same time. (FIGS. 3 and 8 show the helical shape best.)

Upon passing between the knife blades 30 of the rotating cylinders 22 and 24, the continuous web of corrugated board 16 is cut into sheets 34 of the desired length. The sheets 34 are moved towards the pair of take-up rollers 40. A guide 38 of the direct drive cut-off 12 is located between the knife blade cylinders 22 and 24 and take-up rollers 40 for guiding the cut sheet 34. One of the take-up rollers 40, similar to the feed rollers 18, is pivotably mounted and held in position by one or more pneumatic or hydraulic cylinders 42. The take-up rollers 40 move at a speed such that the sheets 34 are moving at a rate faster than the production rate "P". It is desired to move the sheets 34 at a rate slightly higher than the production rate "P" to pull a gap between the sheets, so that the sheets 34 can be shingled (i.e., stacked on each other) during the next operation performed downstream. However, it is contemplated that the take-up rollers 40 not move at a rate too much greater than the production rate "P," or else the sheets 34 may be sculled or the sheet length may not be accurate, as described below.

Figure 2:
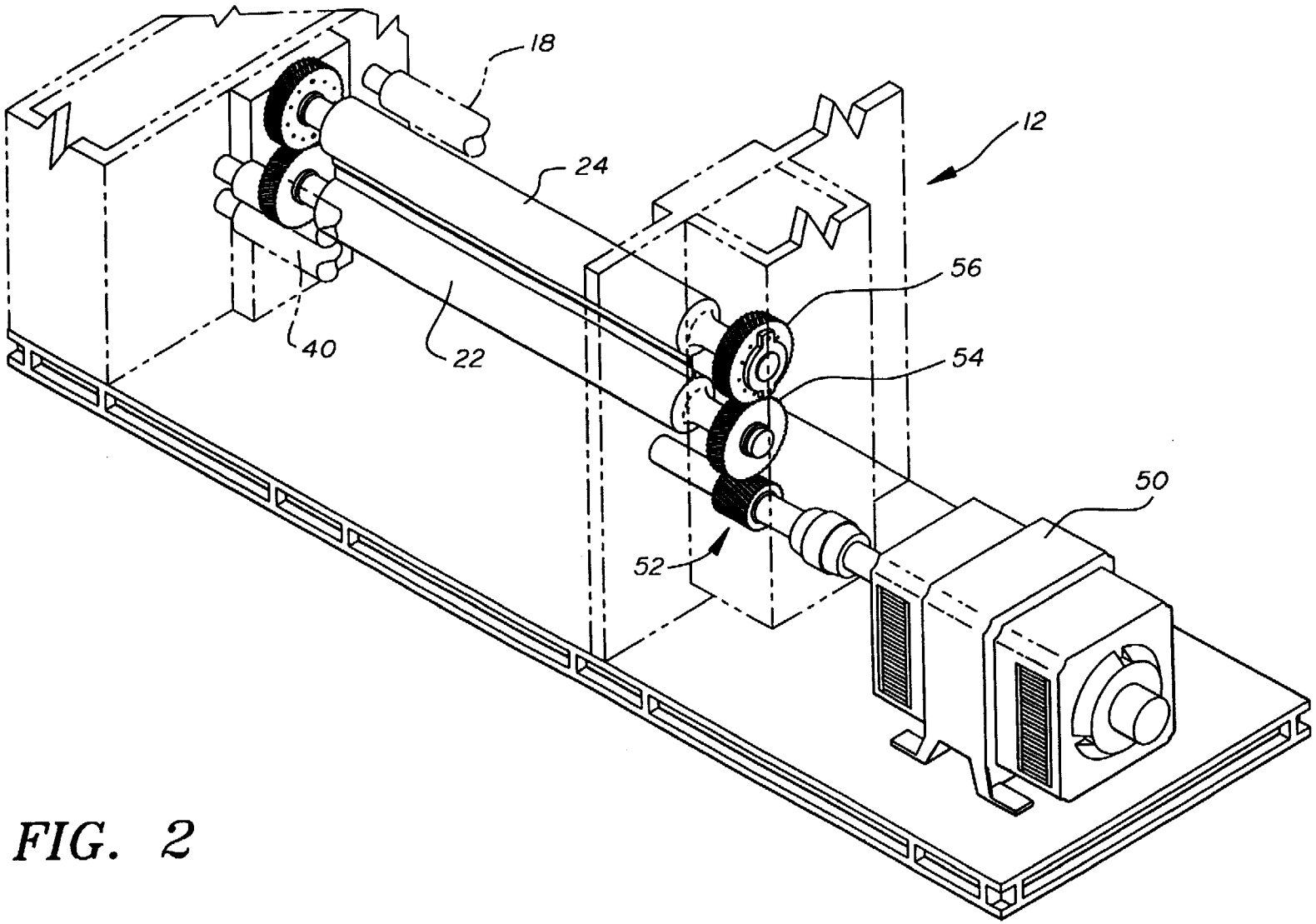
FIG. 2 is a perspective view of the direct drive cut-off showing a direct drive motor.

Referring to FIG. 2, the direct drive cut-off 12 has a direct drive motor 50 which drives the two cylinders 22 and 24 through a coupling device such as a series of gears 52. The series of gears 52 includes a gear 54 mounted to the end of cylinder 22 and a gear 56 mounted to the end of cylinder 24. The gears 54 and 56 engage each other thereby rotating the cylinders 22 and 24 in opposite directions so that the knife blades 30 on cylinder 22 move in the same direction as the knife blades 30 on cylinder 24 to make contact with the continuous web of corrugated board 16.

Figure 3:
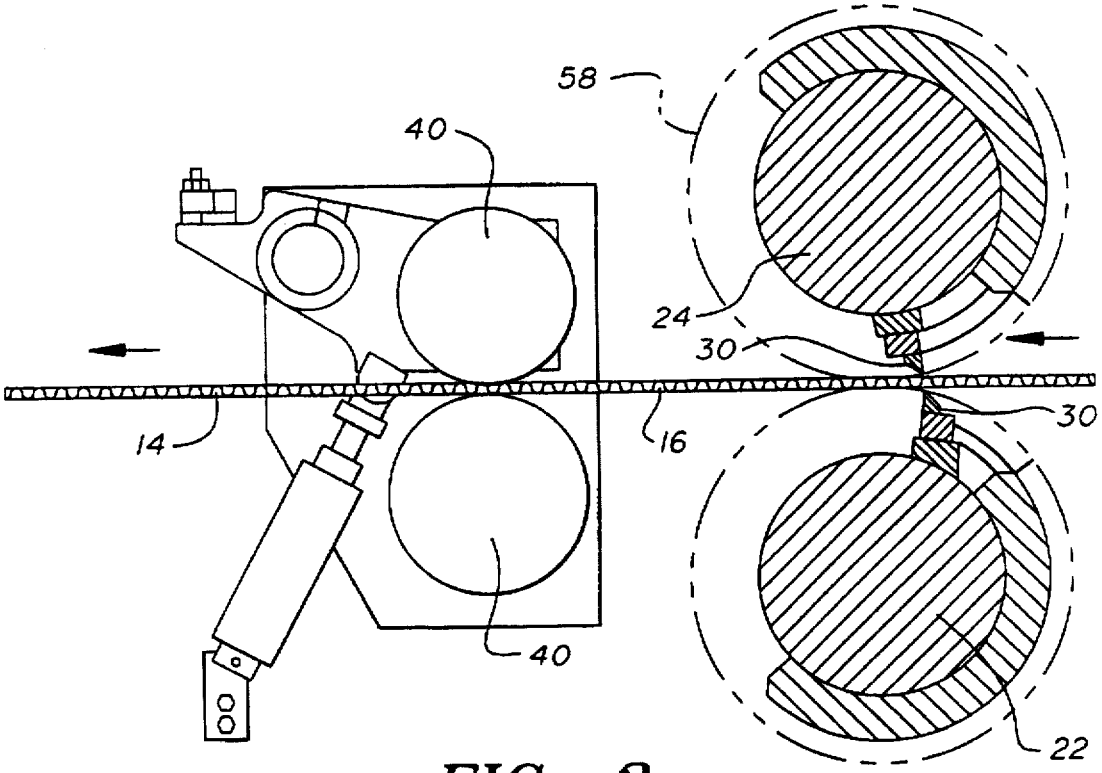
FIG. 3 is an enlarged view of the knife blade cylinders at the beginning engagement position at a knife blade entering edge where the knife blades engage the continuous board.

Referring to FIG. 3, each of the knife blade cylinders 22 and 24 has a synchronous length 58. The path of the knife blades 30 around the cylinders 22 and 24 defines the synchronous length 58. If the knife blade cylinders 22 and 24 are rotated by the direct drive motor 50 (seen in FIG. 2) at a constant angular speed such that the blades 30 engage the corrugated board 16 at the production rate "P," the cut sheet 34 will be of a length equal to the synchronous length. This is not usually desired, so the control unit 28 varies the speed of the knife blade cylinders 22 and 24, as described below. The speed and position of the knife blade cylinders 22 and 24, and their respective knife blades 30, is inputted into the control unit 28 via pulse generators on the knife blade cylinders 22 and 24.

Figure 4:
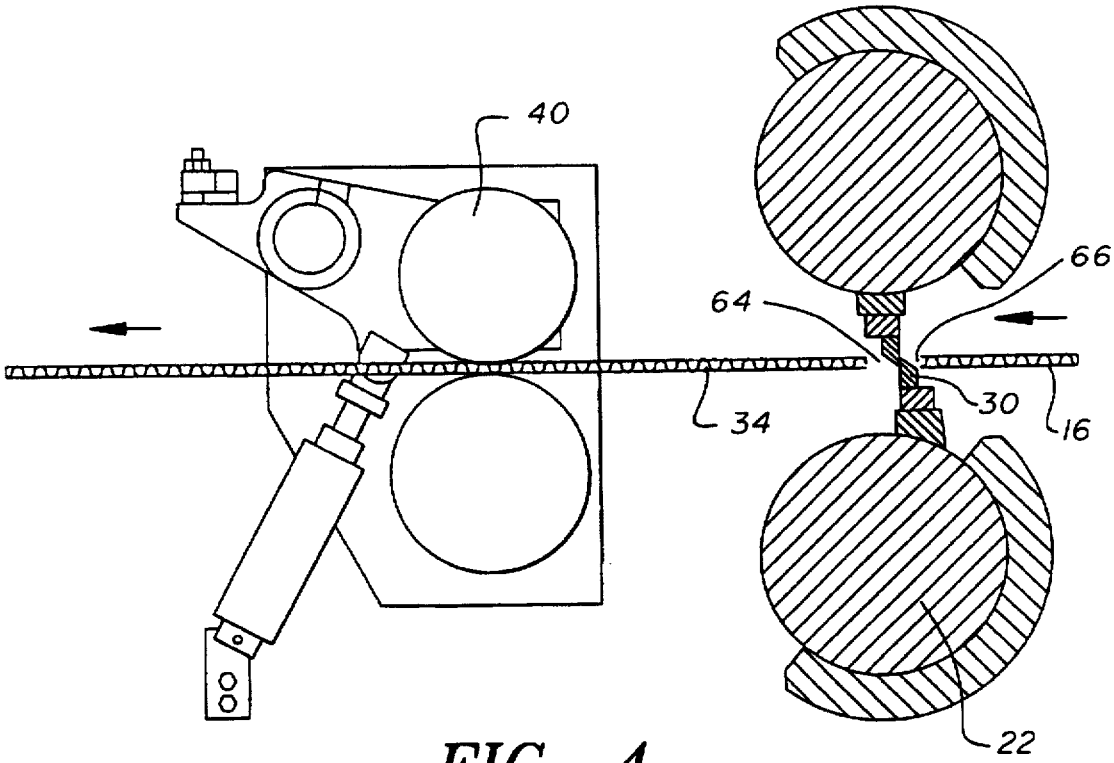
FIG. 4 is an enlarged view of the cylinders showing a mid-point of the engagement of the knife blade at a knife blade exiting edge.
Figure 5:
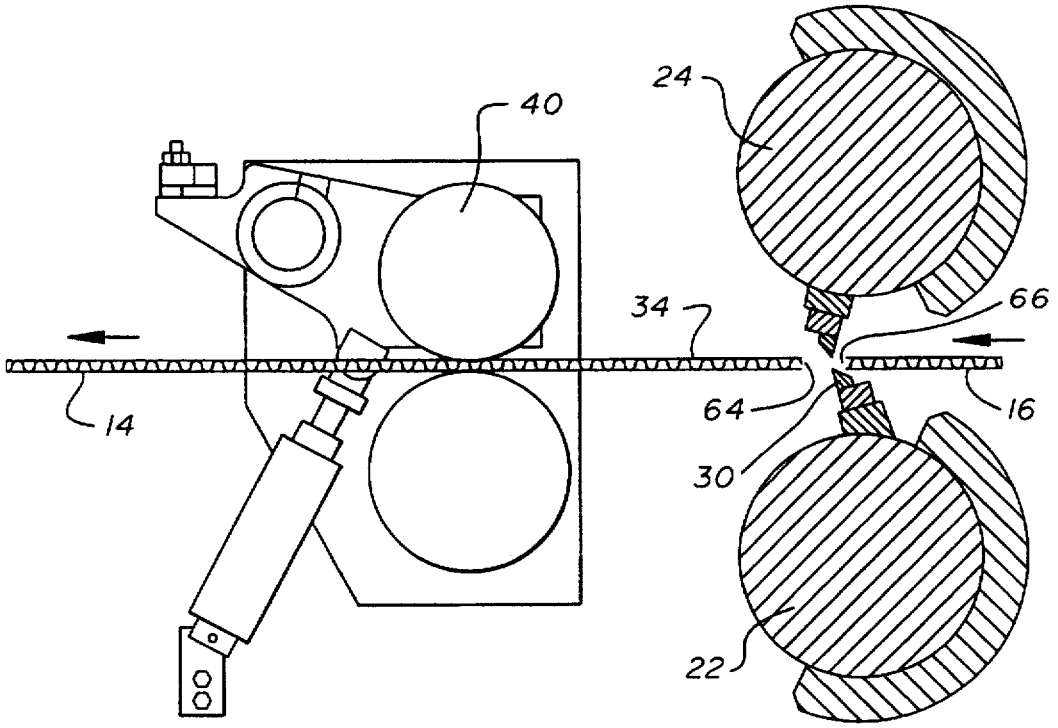
FIG. 5 is an enlarged view of the cylinders showing the end of engagement position.

Referring to FIGS. 3 through 5, the engagement of the corrugated board 16 by the knife blades 30 for cutting the corrugated board 16 into sheets 34 will now be described in further detail. FIG. 3 shows the knife blades 30 entering the board path 14 and engaging the corrugated board 16 at a beginning engagement position. In this way the knife blades 30 penetrate the corrugated board 16 at a knife blade entering edge 70 (as seen in FIG. 7).

Figure 7:
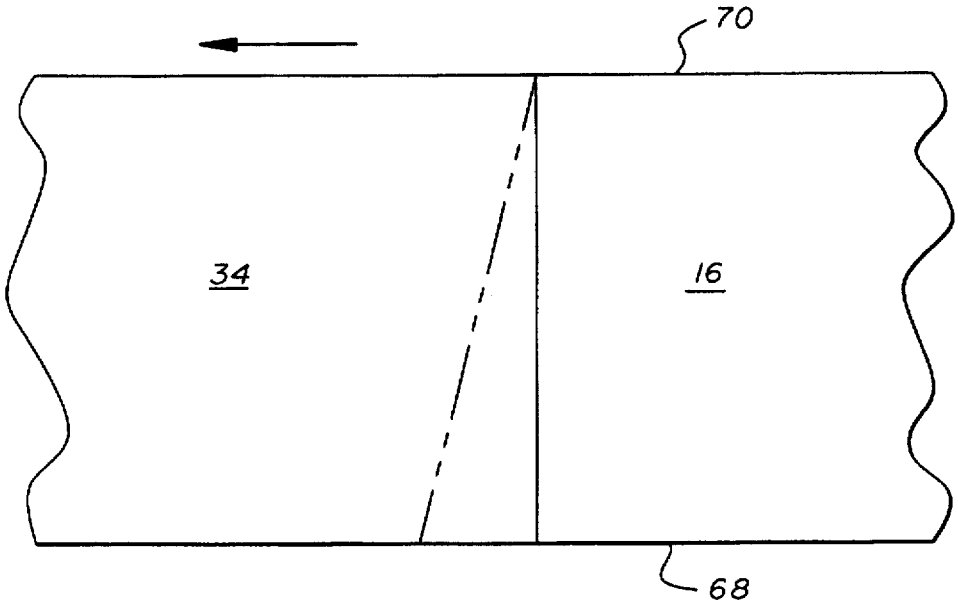
FIG. 7 is a top view of a corrugated board showing the direction of the cut. The path of the cut, if the board was not moving, is shown in phantom.

Referring to FIG. 4, the knife blades 30 are shown at a mid-point position, at a knife blade exit edge 68 (as seen in FIG. 7) after cutting completely through the corrugated board 16 and, thus, producing the sheet 34 of the desired length. The sheet 34 has a trailing edge 64 and the corrugated board 16 has a leading edge 66 in proximity to the knife blades 30. At this time, the knife blade cylinders 22 and 24 must be rotating at the proper speed such that the knife blades 30 are moving at the speed which is equal to the production rate "P" of the corrugated board 16 (i.e., the speed the corrugated board 16 is moving through the board path 14), so that the knife blades 30 do not damage the trailing edge 64 of the sheet 34 or the leading edge 66 of the continuous piece of corrugated board 16.

At this mid-point of the blade engagement with the corrugated board 16, the take-up roller 40 is pulling the cut sheet 34 away from the knife blade cylinders 22 and 24 at a rate higher than the production rate "P," therein creating a gap between the cut sheet 34 and the continuous piece of corrugated board 16 which follows. Prior to the sheet 34 being cut from the continuous web of corrugated board 16, that part of board 16 which is in contact with the take-up rollers 40 is slipping in relation to the take-up rollers 40. This slipping between the corrugated board 16 and the take-up rollers 40 can result in scuffing of the corrugated board 16.

A way to prevent the board from slipping, is to vary the speed of the take-up rollers 40 by the control unit 28 in relation to the position of the knife blades 30 relative to the board path 14. Therefore, the take-up rollers 40 would be accelerated as soon as the sheet 34 is cut from the continuous web of corrugated board 16. A benefit to the alternative is that the board 16 is not pulled by the take-up rollers 40 in a jerking motion when the leading edge 66 makes contact with the take-up rollers 40. In addition, the board 16 is not damaged by rubbing because of the difference in speed.

Referring to FIG. 5, the knife blades 30 are shown at an end engagement position as the knife blades 30 leave the path 14 of the corrugated board 16 and the sheet 34.

Figure 6:
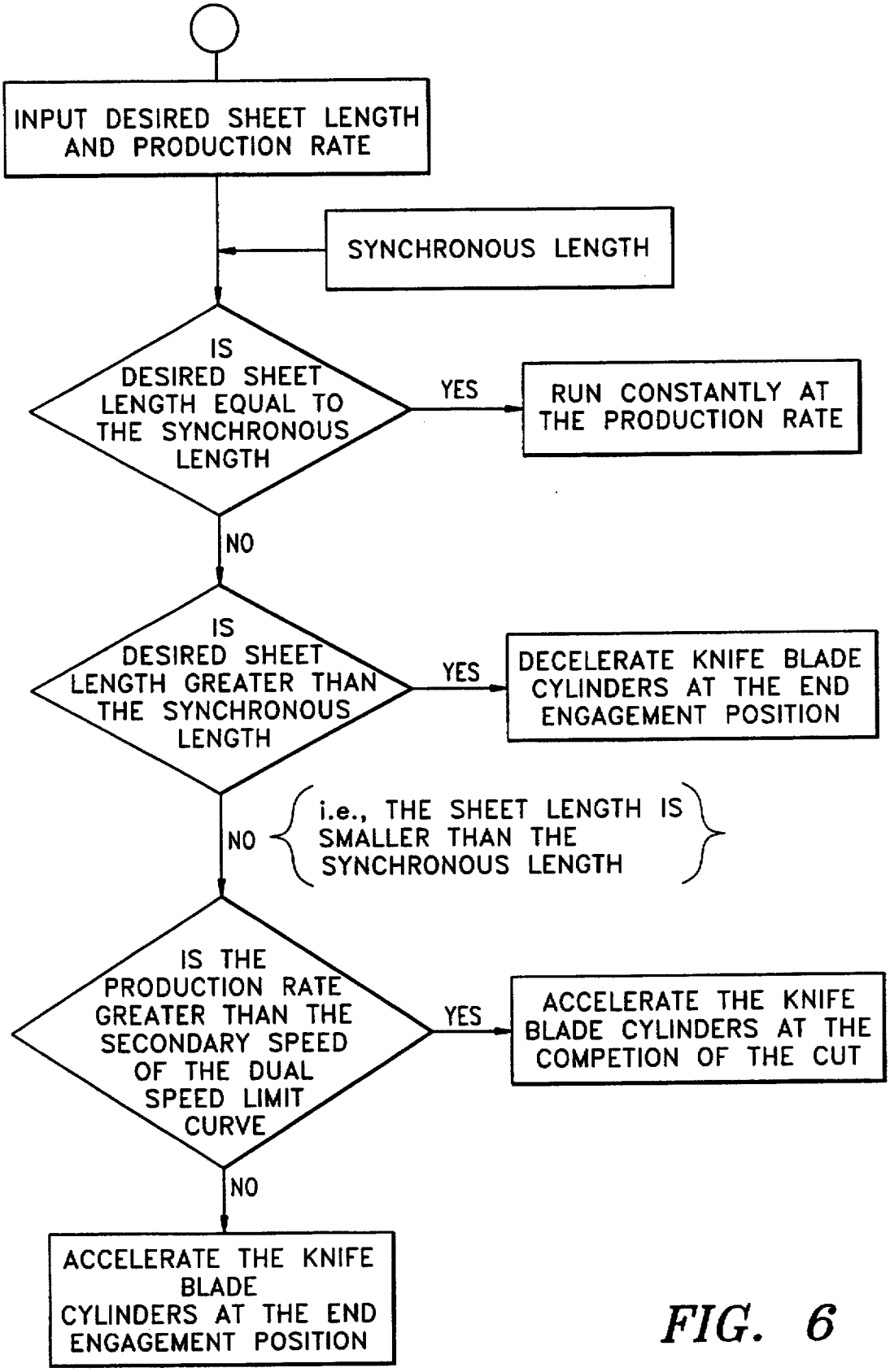
FIG. 6 is a schematic view of the control mechanism.

Referring to FIG. 6, in operation the desired sheet length and production rate is input into the control unit 28 of the direct drive cut-off 12. The control unit 28 "knows" the synchronous length. The control unit 28 compares the desired sheet length to the synchronous length.

If the desired sheet length is equal to the synchronous length, the knife blade cylinders 22 and 24 run at a constant production rate, "P." For example, if the synchronous length is 40 inches, the desired sheet length is 40 inches, and the production rate "P" is a thousand feet per minute, then the knife blade cylinders 22 and 24 must be driven by the direct drive motor 50 at a speed of 300 revolutions per minute.

If the desired sheet length is greater than the synchronous length, the direct drive motor 50 must slow down or decelerate the knife blade cylinders 22 and 24 during the segment when the knife blades 30 are not in engagement with the corrugated board 16 (i.e., between the end engagement position and the beginning engagement position) so that a length greater than the synchronous length can pass through the cut-off before the knife blades 30 engage the corrugated board 16. If the two knife blade cylinders 22 and 24 are slowed down prior to the end engagement position, the leading edge 66 of the corrugated board 16 would hit the knife blades 30.

Referring to FIG. 7, helically mounted knife blades rotate about the axes of cylinders 22 and 24 to cut the corrugated board 16 such that the cutting of the corrugated board 16 begins when the knife blade enters edge 70 (i.e., the beginning engagement position) of the corrugated board 16, progresses across the corrugated board 16, and ends when the knife blade exits edge 68 of the corrugated board 16. The angle of rotation of the knife blades 30 (and the knife cylinders 22 and 24) during which the knife blades 30 are in engagement with the board path is the blade engagement angle. The blade engagement angle is the sum of the cut angle and the clearance angle, as seen in FIG. 8.

The cut angle is the angle through which the knife blade cylinders 22 and 24 rotate when the knife blades 30 cut the corrugated board 16. The cut angle begins when the knife blades 30 first engage the corrugated board 16 at the knife blade entering edge 70 and ends when the knife blades 30 complete the cut of the sheet 34 from the corrugated board 16 at the knife blade exit edge 68. The cut angle in FIG. 8 represents the helical wrap of the blade around the knife blade cylinders.

FIG. 7 shows in phantom the cut of the board if the board were not moving, but with the knife blade cylinders still mounted at an angle relative to the path of the board. (The angle is exaggerated.)

The clearance angle is the angle through which the knife blade cylinders 22 and 24 rotate after the cutting of the sheet 16 is completed to clear the path of the board. That angle begins when the knife blade 30 is in a position to complete the cut (i.e., at the knife blade exiting edge 68) of sheet 34 from the board 16 and ends when the exiting edges of the two blades are clear of each other and the corrugated board 16.

Referring to FIG. 6, if the desired sheet length is less than the synchronous length, then the production rate "P" is compared to an established dual speed limit curve. The following table shows some values on such a dual speed limit curve:

| Desired Sheet Length IN | Maximum Production Rate (or Primary Speed) FT/MIN | Secondary Speed FT/MIN |
|---|---|---|
| 20 | 280 | 230 |
| 22 | 330 | 280 |
| 24 | 380 | 330 |
| 26 | 440 | 390 |
| 28 | 520 | 460 |
| 30 | 600 | 540 |
| 32 | 690 | 640 |
| 34 | 790 | 750 |

If the desired production rate is less than the secondary speed, such as the examples given in the Table, the direct drive motor 50 does not begin the acceleration of the knife blade cylinders 22 and 24 until the blade engagement with the corrugated board 16 is complete (i.e., at the end engagement position). Increasing the speed of the two knife blade cylinders 22 and 24 earlier than the end engagement position is not desirable below the secondary speed, since the take-up rollers 40 may not be able to accelerate the sheet 34 fast enough to create a sufficient gap between sheet 34 and board 16 and prevent the knife blades 30 from hitting the trailing edge of the leading cut sheet 34.

On the other hand, if the desired production rate for a sheet length less than the synchronous length is greater than the secondary speed, then the direct drive motor 50 begins accelerating the knife blade cylinders 22 and 24 during the period prior to the completion of the blade engagement (i.e., the end engagement position) but after the cut is complete at the knife blade exit edge 68. Increasing the production rate faster than the secondary speed, up to the primary speed (or maximum production rate), would not otherwise be possible due to machinery constraints, such as inertia, if the knife blade cylinders 22 and 24 were not accelerated prior to the end engagement position.

Referring to FIG. 6, it is contemplated that the take-up rollers 40 can also be linked to the control unit 28 so that the rollers 40 can be run at production rate "P" when they engage the corrugated board 16 as in FIG. 1, but can be accelerated as soon as the knife blades 30 complete cutting the sheet 34 from the corrugated board 16 prior to reaching the end engagement position the knife blades.

The present invention may be embodied in other specific forms without departing from the spirit or essential attributes thereof and, accordingly reference should be made to the appended claims, rather than to the foregoing specification, as indicating the scope of the invention. For example, the knife blades 30 need not be helically mounted. In this case the cut angle would be 0°.

I claim:

1. A method for cutting sheets of a preselected length from a continuous web, comprising the following steps:

providing a direct drive cut-off having a pair of cylinders, each of the cylinders having a knife blade, the path of the knife blade around the cylinder defining a synchronous length;

passing the continuous web in a web path direction through a web path between the cylinders at a production rate;

rotating the cylinders in opposite directions so that the knife blades move in proximity to each other in the web direction to cut the continuous web into sheets such that the knife blades engage the web path and continuous web at a beginning engagement position, depart the web path at an end engagement position, and complete the cut prior to the end engagement position;

accelerating the sheets downstream of the cylinders; and controlling the cylinders by a control means for accelerating and decelerating the rotational speed of the cylinders so that the knife blades engage the continuous web at the preselected length cutting the web into sheets, the control means being responsive to the production rate and the desired sheet length so that for sheets that are shorter than the synchronous length, the control means accelerates the cylinders after the knife blades complete the cut but before the knife blades reach the end engagement position when the production rate is above a set speed, and begins accelerating the cylinders when the knife blades reach the end engagement position for production rates below the set speed.

2. A method for increasing the production rate of cutting sheets of a specific length from a continuous web as in claim 1 wherein the sheet accelerating means is driven at a constant rate above the production rate.

3. A method for increasing the production rate of cutting sheets of a specific length from a continuous web as in claim 1 wherein the sheet accelerating means is accelerated when the knife blades complete the cut but before blade engagement is complete.

4. A method for cutting a continuous board moving through a cutting apparatus into sheets of preselected length comprising:

rotating a pair of driven knife blade cylinders having helically mounted knife blades for cutting the continuous board into sheets in opposite directions in synchronization with each other so that the knife blades begin making a cut across the board at one edge of the board and end the cut at the opposite edge of the board, the knife blades clearing the path of the board after the end of the cut at an end engagement position;

accelerating the sheets cut from the board to a speed greater than the speed at which the board is traveling, creating a gap between the board and each successive cut sheet; and accelerating the rotational speed of the knife blade cylinders to cut the board into sheets having a length less than a synchronous length of the knife blade cylinders such that i) when the speed at which the board is traveling is greater than a preselected speed, the controller accelerates the cylinders after the board is cut, but before the knife blades reach the end engagement position, and ii) when the speed at which the board is traveling is less than the preselected speed, the controller begins accelerating the cylinders after the end engagement position is reached.

* * * * *